US010442567B2

(12) United States Patent
Tattam et al.

(10) Patent No.: US 10,442,567 B2
(45) Date of Patent: Oct. 15, 2019

(54) TRANSPORT AND STORAGE SYSTEM

(71) Applicant: SOFTBOX SYSTEMS LIMITED, Buckinghamshire (GB)

(72) Inventors: Edwin Francis Tattam, Somerset (GB); Ross Malcolm Beech, Chesham (GB); James Nathan Jarvis, Bedfordshire (GB)

(73) Assignee: SOFTBOX SYSTEMS LIMITED, Buckinghamshire (GB)

( * ) Notice: Subject to any disclaimer, the term of this patent is extended or adjusted under 35 U.S.C. 154(b) by 0 days.

(21) Appl. No.: 15/365,907

(22) Filed: Nov. 30, 2016

(65) Prior Publication Data

US 2017/0203875 A1 Jul. 20, 2017

Related U.S. Application Data

(63) Continuation of application No. PCT/GB2015/000157, filed on Jun. 1, 2015.

(30) Foreign Application Priority Data

May 30, 2014 (GB) ..... 1409689.5

(51) Int. Cl.
*B65D 19/38* (2006.01)
*B65D 19/06* (2006.01)
(Continued)

(52) U.S. Cl.
CPC ..... *B65D 19/385* (2013.01); *B65D 19/06* (2013.01); *B65D 21/0201* (2013.01);
(Continued)

(58) Field of Classification Search
CPC ..... B65D 19/385; B65D 81/3816; B65D 21/0201; B65D 19/06; B65D 2519/00218; B65D 2519/00597; B65D 2519/00497; B65D 2519/00452; B65D 2519/00323; B65D 2519/00293; B65D 2519/00273; B65D 2519/00208; B65D 2519/00203; B65D 2519/00194; B65D 2519/00159; B65D 2519/00139; B65D 2519/00134;
(Continued)

(56) References Cited

U.S. PATENT DOCUMENTS 3,480,196 A * 11/1969 De Simas ..... B65D 19/20 108/51.3
3,910,452 A * 10/1975 Szasz ..... B65D 88/34 220/216

(Continued)

*Primary Examiner* — Kareen K Thomas
(74) *Attorney, Agent, or Firm* — Brian R. Galvin; Galvin Patent Law LLC

(57) ABSTRACT

The present invention relates to the field of the transportation and storage of goods and to a transport and storage system and, in particular, a system for the transportation and storage of goods such as palletized goods and self-standing goods. The present invention seeks to provide a system that can enable goods to be securely and reliably horizontally, vertically and offset stacked, despite different sizes of goods and support members therefor, such as pallets, whereby wasted volumes arising from the presence of irregular loads, pallets or pallets of different levels or different load ratings in storage and transport can be minimized.

17 Claims, 12 Drawing Sheets

(51) Int. Cl.

| | |
|---|---|
| ***B65D 21/02*** | (2006.01) |
| ***F25D 3/06*** | (2006.01) |
| ***B65D 81/38*** | (2006.01) |
| ***B65D 71/00*** | (2006.01) |

(52) U.S. Cl.

CPC ..... *B65D 71/0096* (2013.01); *B65D 81/3816* (2013.01); *F25D 3/06* (2013.01); *B65D 81/389* (2013.01); *B65D 2519/00029* (2013.01); *B65D 2519/00064* (2013.01); *B65D 2519/0091* (2013.01); *B65D 2519/0096* (2013.01); *B65D 2519/00099* (2013.01); *B65D 2519/00129* (2013.01); *B65D 2519/00134* (2013.01); *B65D 2519/00139* (2013.01); *B65D 2519/00159* (2013.01); *B65D 2519/00164* (2013.01); *B65D 2519/00169* (2013.01); *B65D 2519/00174* (2013.01); *B65D 2519/00184* (2013.01); *B65D 2519/00194* (2013.01); *B65D 2519/00203* (2013.01); *B65D 2519/00208* (2013.01); *B65D 2519/00218* (2013.01); *B65D 2519/00273* (2013.01); *B65D 2519/00293* (2013.01); *B65D 2519/00323* (2013.01); *B65D 2519/00333* (2013.01); *B65D 2519/00373* (2013.01); *B65D 2519/00452* (2013.01); *B65D 2519/00497* (2013.01); *B65D 2519/00597* (2013.01); *B65D 2519/00601* (2013.01); *B65D 2519/00661* (2013.01); *B65D 2519/00711* (2013.01); *B65D 2519/00805* (2013.01); *B65D 2519/00975* (2013.01); *B65D 2571/00037* (2013.01); *B65D 2571/00055* (2013.01); *F25D 2303/082* (2013.01); *F25D 2303/0843* (2013.01); *F25D 2303/0844* (2013.01)

(58) Field of Classification Search

CPC ..... B65D 2519/00129; B65D 2519/00099; B65D 2519/00064; B65D 2519/00029; B65D 2519/0096; B65D 2519/00711; B65D 2519/00661; F25D 3/06; F25D 2303/0843; F25D 2303/082; F25D 2303/0844

USPC ..... 220/592.01–592.28

See application file for complete search history.

(56) References Cited

U.S. PATENT DOCUMENTS

| | | | | | |
|---|---|---|---|---|---|
| 3,995,736 | A * | 12/1976 | Lawson | B65D 19/20 | 108/51.3 |
| 4,317,451 | A * | 3/1982 | Cerwin | A61B 17/0644 | 227/19 |
| 4,809,851 | A * | 3/1989 | Oestreich, Jr. | B65D 7/32 | 206/511 |
| 5,597,084 | A * | 1/1997 | Parasin | B65D 11/1873 | 206/600 |
| 6,041,958 | A * | 3/2000 | Tremelo | B65D 19/06 | 206/600 |
| 7,004,344 | B2 * | 2/2006 | Fulton | B65D 11/1873 | 220/324 |
| 7,757,876 | B1 * | 7/2010 | Ditter | A01J 25/15 | 220/4.28 |
| 8,112,859 | B2 * | 2/2012 | Vroon | B29C 45/0055 | 206/499 |
| 8,616,370 | B2 * | 12/2013 | Allegretti | B65D 19/06 | 108/51.11 |
| 8,708,178 | B2 * | 4/2014 | Kvols | B65D 19/12 | 206/600 |
| 8,794,464 | B2 * | 8/2014 | Yamauchi | B65D 11/1873 | 217/12 R |
| 8,813,985 | B2 * | 8/2014 | Schloesser | B65D 7/24 | 206/600 |
| 8,887,914 | B2 * | 11/2014 | Allegretti | B65D 19/06 | 206/386 |

* cited by examiner

Figure 1A
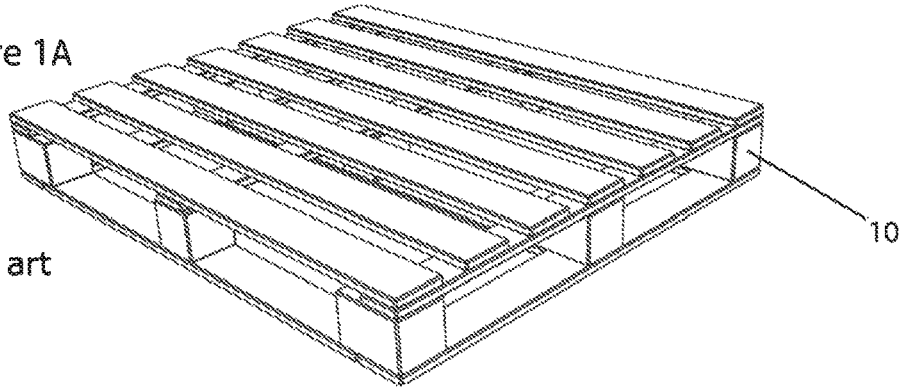
Prior art
Figure 1B
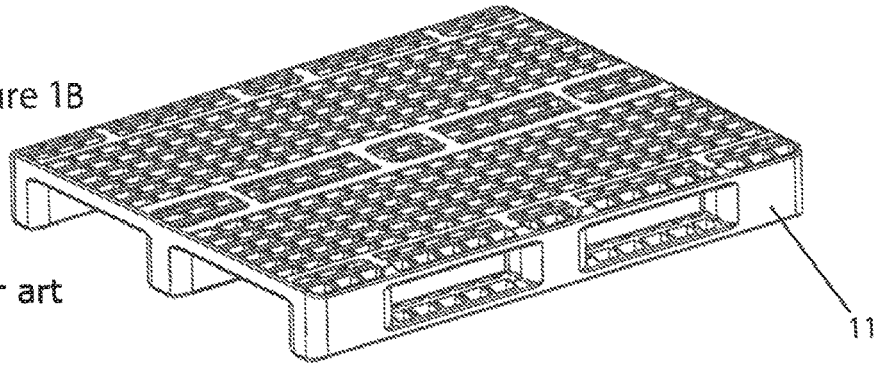
Prior art
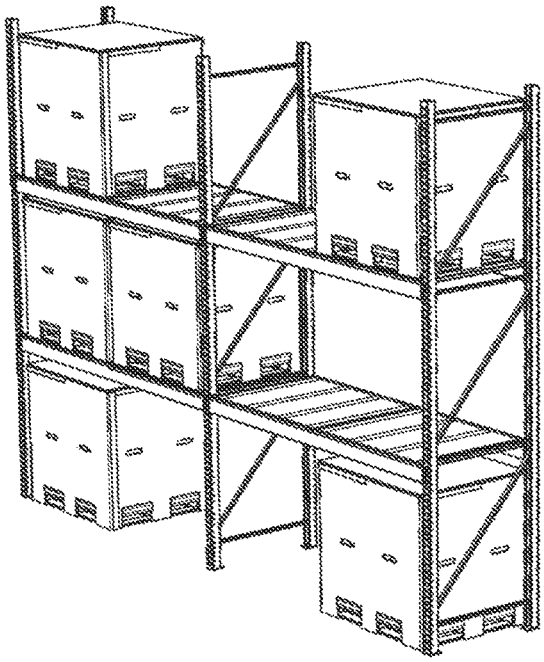
Figure 2A

Figure 4
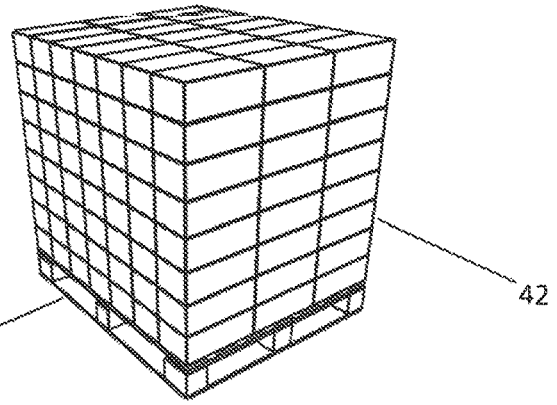
Figure 5A
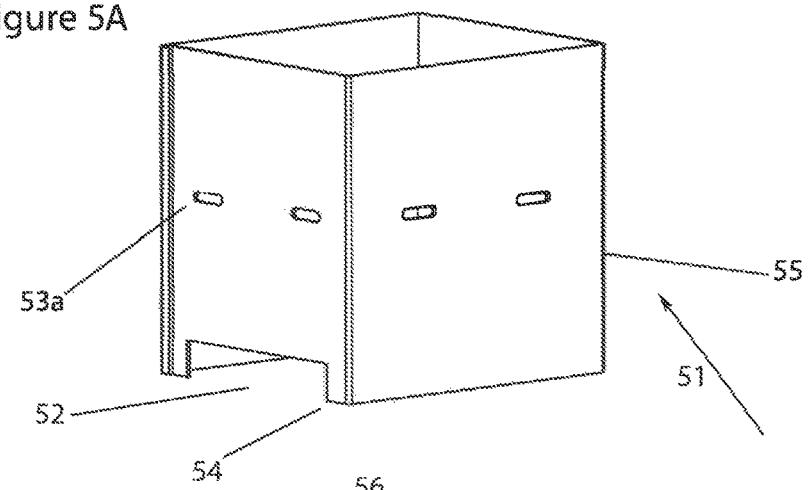
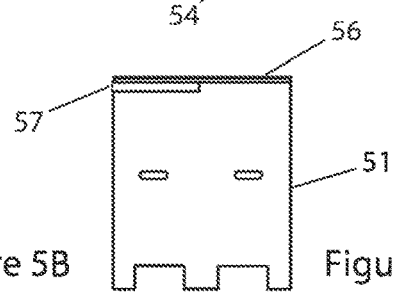
Figure 5B
Figure 5C
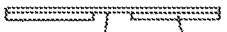
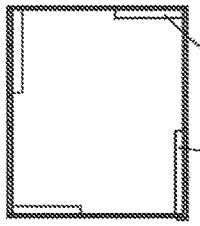
Figure 5D
Figure 5E
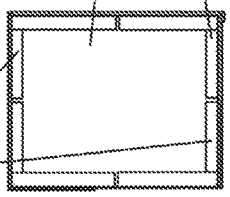

Figure 5F
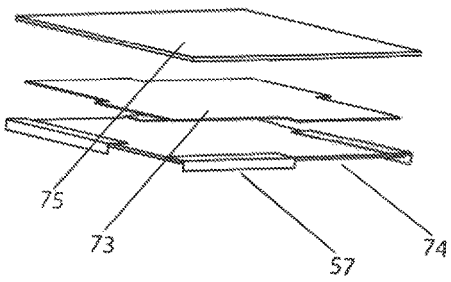
Figure 5G
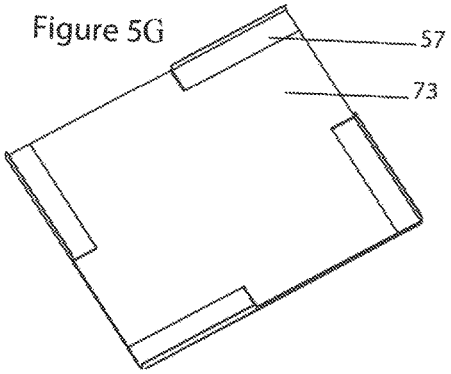
Figure 5H
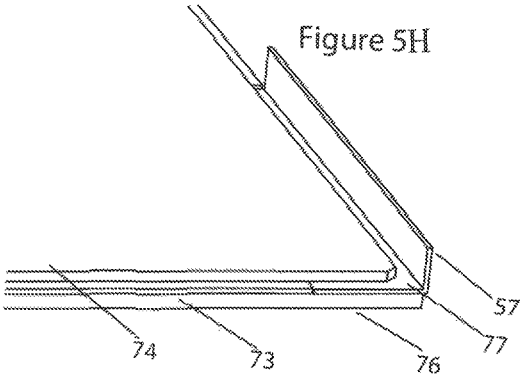
Figure 5I
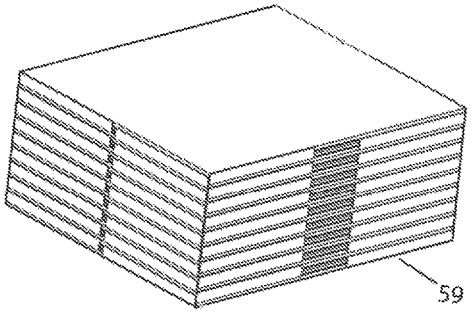
Figure 5K
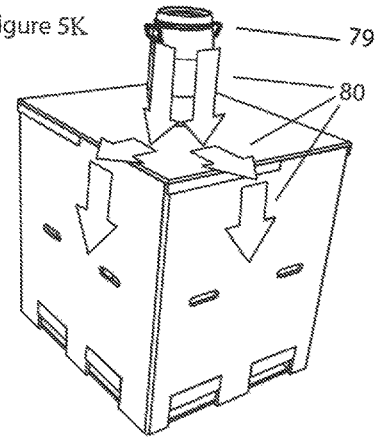
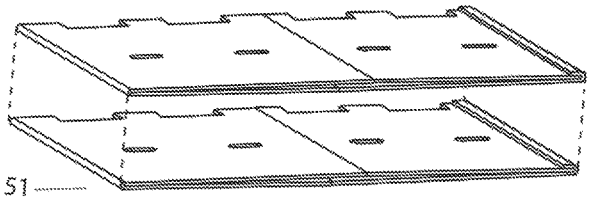
Figure 5J Figure 6E
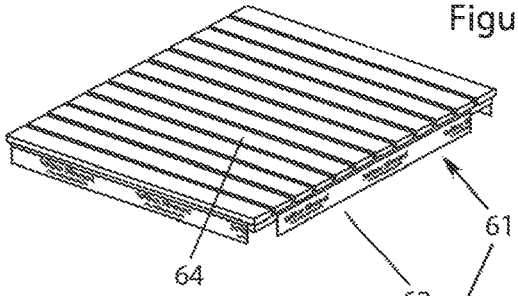
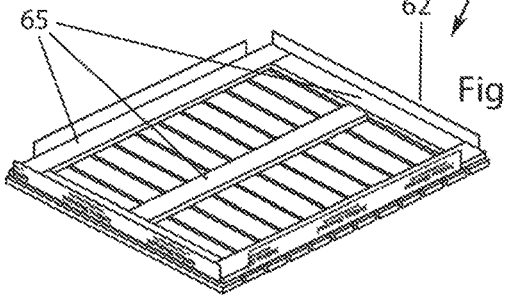
Figure 6F
Figure 6G
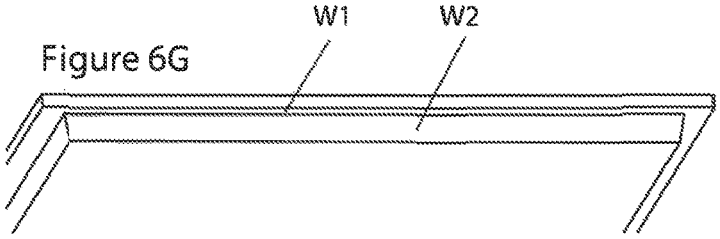
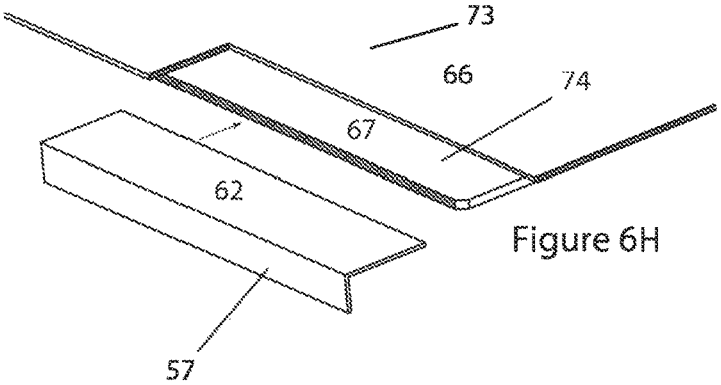
Figure 6H
Figure 6I
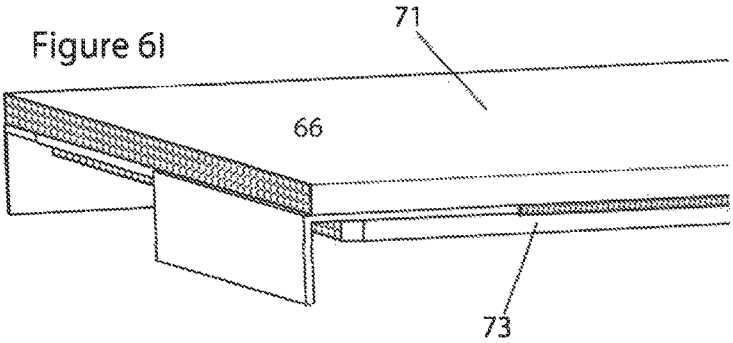

Figure 7A
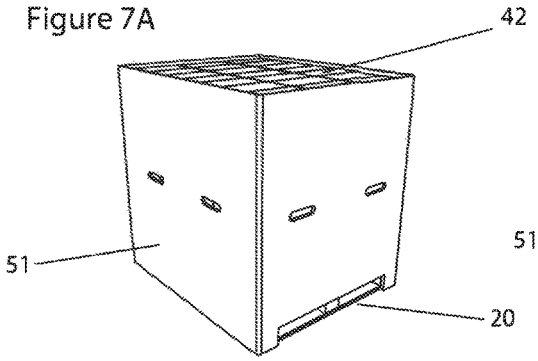
Figure 7B
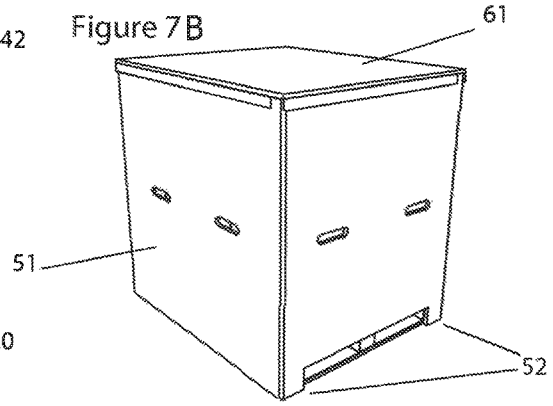
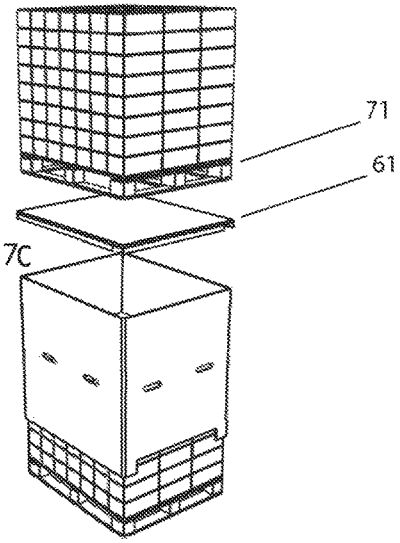
Figure 7C
Figure 7D
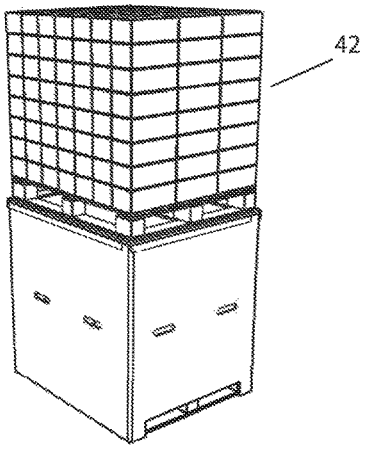
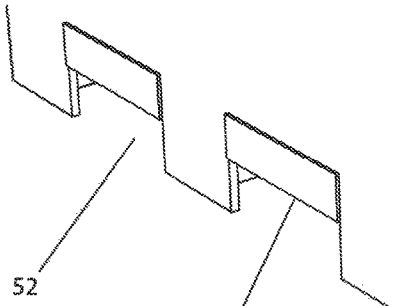
Figure 7E
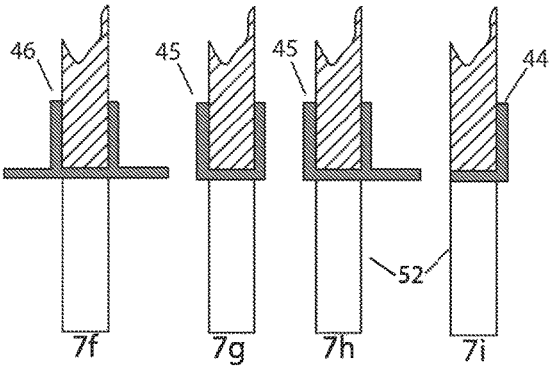

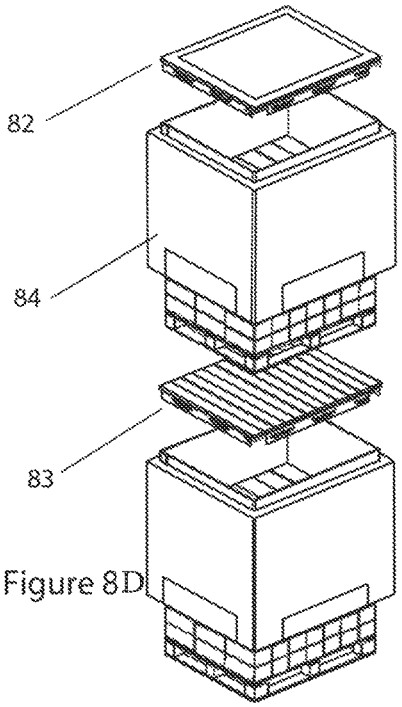
Figure 8D
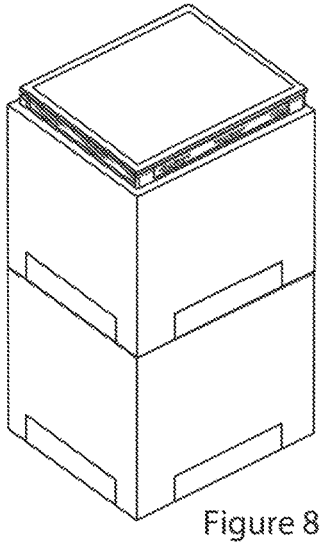
Figure 8E
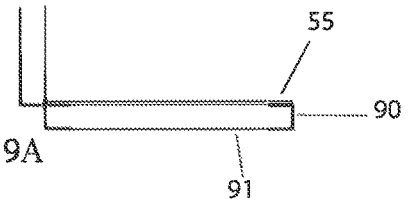
Figure 9A
Figure 9B
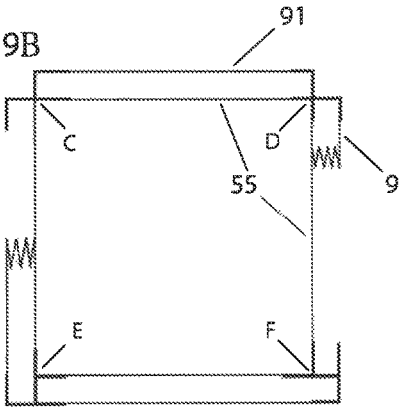
Figure 9G
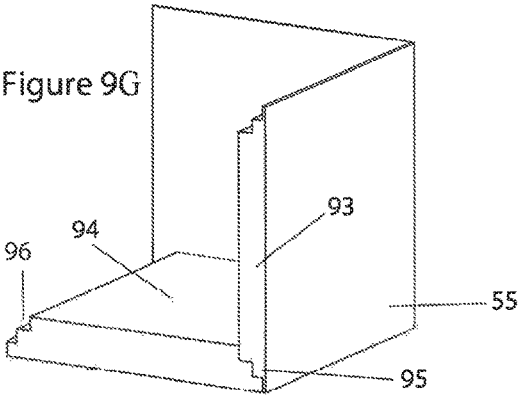
Figure 9C
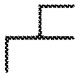
Figure 9D
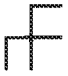
Figure 9E
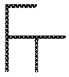
Figure 9F
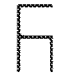

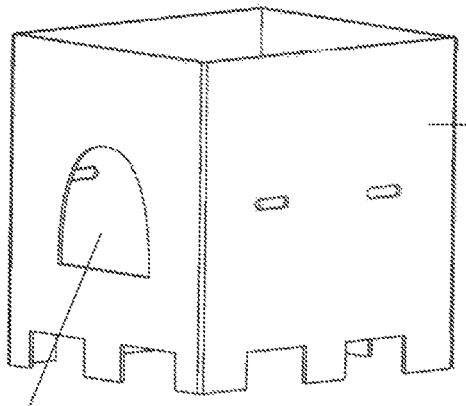
Figure 10A
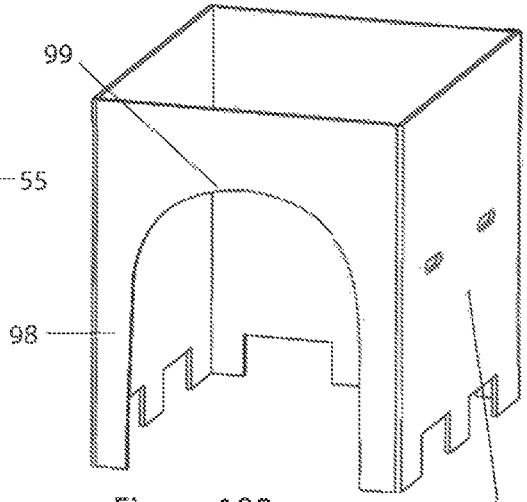
Figure 10B
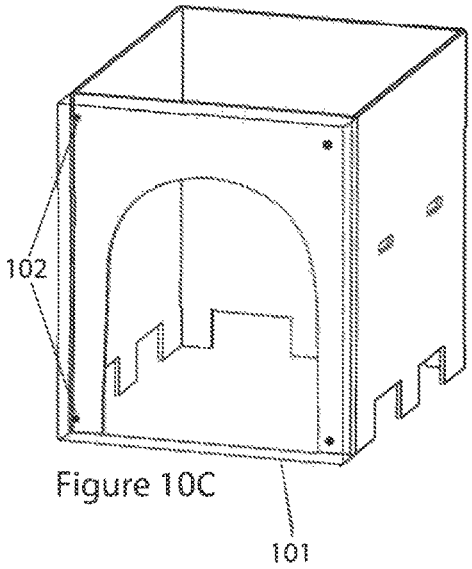
Figure 10C
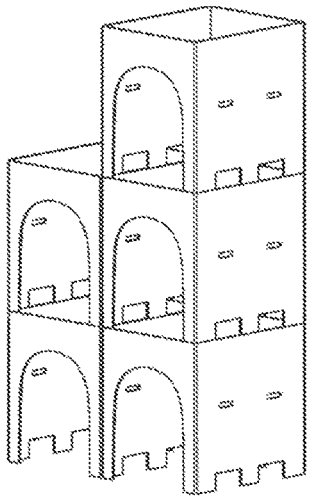
Figure 11
Figure 12
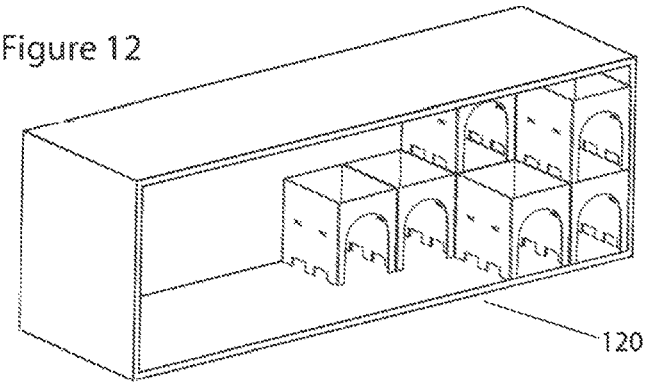

Figure 13A
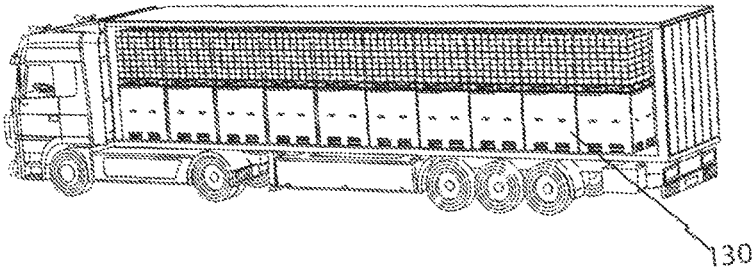
Figure 13B
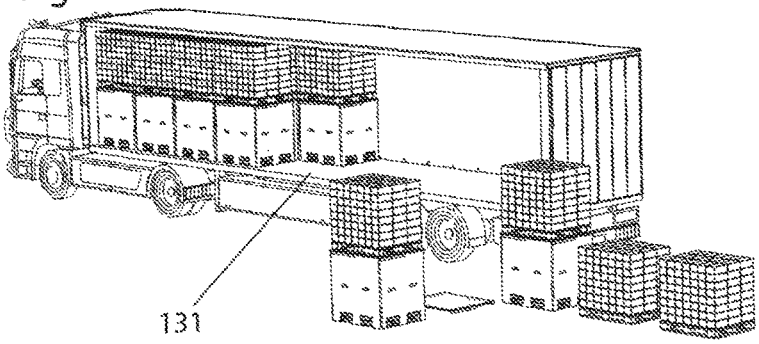
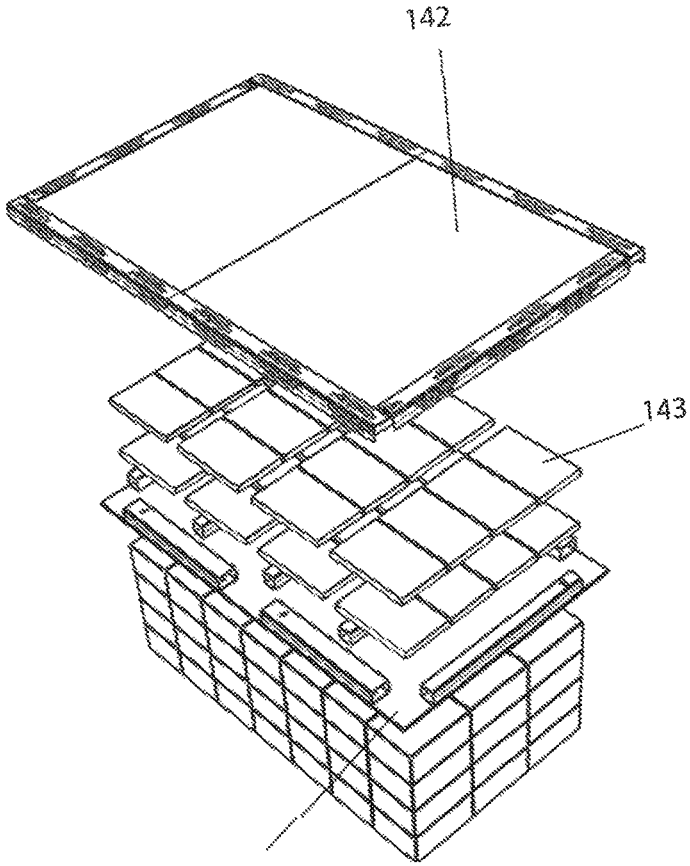
Figure 14

151
150

153

155

TRANSPORT AND STORAGE SYSTEM

CROSS-REFERENCE TO RELATED APPLICATIONS

This application is a continuation of PCT patent application serial number PCT/GB2015/000157, published as WO 2015/181515, titled "A TRANSPORT AND STORAGE SYSTEM" and filed on Jun. 1, 2015, which claims priority to GB1409689.5 titled "A TRANSPORT AND STORAGE SYSTEM" and filed on May 30, 2014, the entire specification of each of which is hereby incorporated by reference in its entirety.

BACKGROUND OF THE INVENTION

Field of the Invention

The present invention relates to the field of the transportation and storage of goods and to a transport and storage system and in particular, but not necessarily restricted thereto, a system for the transportation and storage of palletized goods.

Background to the Invention

In the field of logistics, that is the field of movement and supply of produce and materials, the transportation of intermediate and finished products is frequently assisted by the use of pallets. A pallet typically comprises a flat rectangular structure that supports goods in a stable fashion whether remaining in a transport vehicle—such as a lorry, container etc., a warehouse, storage area etc. or being lifted by a forklift, pallet truck, front loader, or other handling device. Pallets are commonly found in a wide range of industries and services, forming an essential part of many mechanical handling systems in factories, distribution warehouses and the like. Pallets are manufactured from a variety of materials, most commonly from: timber 10 per FIG. 1A; plastics 11 per FIG. 1B; paper/fiberboard and sometimes from metal. Wooden pallets typically consist of three or four support stringers that support several deck boards, on top of which goods are placed. Square or nearly square pallets help a load resist tipping. Goods or shipping containers are often placed on a pallet secured with strapping, stretch wrap or shrink-wrap and shipped. Pallets make it easier to move heavy stacks and are extremely adaptable, not being limited to specific dimensions of height, weight or bulk size as such. Loads with pallets under them can be hauled by forklift trucks of different sizes, or even by hand-drawn pallet trucks. Not only are there grades of durability, heavy weights need to be supported by sufficiently strong pallets. Most pallets can easily carry a load of 1,000 kg (2,205 lbs.), although, operators must be aware that lightweight pallets may be provided for less significant loads and the load rating must always be confirmed prior to use, given that group transport organizations exist, where pallet products are shared between groups of users, for different types of goods.

In some areas of logistics, it has been found that the pallet has become the structural foundation of a unit load, which allows handling and storage efficiencies. For example, a unit load device (ULD) typically comprises a container used to load luggage, freight and mail on aircraft that allows a large quantity of cargo to be bundled into a single unit. Since this leads to fewer units to load, it saves ground crews time and effort and helps prevent delayed flights. Each ULD has its own packing list (or manifest) so that its contents can be checked and tracked. Further, the extensive use of 40' and 20' containers for transport has spurred the use of pallets because such shipping containers provide smooth and level surfaces suitable for easy pallet movement and bulk stacking of a large number of palletized loads. It is presently understood that, over half a billion pallets are made each year and about two billion pallets are in use across the United States, for example.

Typical pallet sizes are: 1200×1000 mm; 1200×800 mm; 48"×40"; being three of six ISO (International Standards Organization) sanctioned standard pallets, although there is a plethora of different sizes for specific tasks, globally. The fork tines of a fork lift or other lifting device may have limited access to a pallet, being limited to only one side, to two sides or can be provided on all four sides (1-, 2-, or 4 way entry). Pallets are reusable packaging items. Every pallet that is built could potentially be used and used again until such a time when it will need to be replaced. The lack of a single international standard for pallets causes substantial continuing expense in international trade. A single standard is difficult because of the wide variety of needs a standard pallet would have to satisfy: passing by or through doorways, placing within standard containers and unit load devices (ULDS), noting that weight, size and bulk affect the use of a standard type of load and use of a standard can reduce labor costs.

In order to maximize the storage capacity of a warehouse pallets are placed upon pallet racks, as shown in FIG. 2A the common frame comprising at least four vertical posts is fitted with beams that can be connected at various levels to the posts, whereby to provide racking systems which can be adjusted in height to provide a number of support platforms each for individual pallets. Whilst pallets can be stacked one atop another, this can be inconvenient; stabilization can be required and, not infrequently, can be hazardous, with a risk of breakage of goods through poor handling and a potential collapse over time.

With regard to commercial vehicles and the load capacity of such, especially of the curtain sided type, reference is made to FIG. 2B. The individual pallets must either have boxes of sufficient strength to support the weight of another pallet, when stacked vertically per load "A", taking into account the basic capability of the lower pallets to support further palletized loads, with regard to a flat upper surface, ability/integrity to take further weight etc. The load of an upper pallet can be spread upon two lower pallets, which can provide a greater degree of stabilization, per load "B"; load "C" comprises a disparate array of a base level placement of pallets, with the volume above the pallet having loosely placed goods, although there will be instances of there being no higher stacking or no such further loosely placed load, increasing the unit cost of freight. Additionally, the goods will need to be made secure with straps, locking catches etc., which are not detailed in this Figure. It will need to be borne in mind that when a commercial vehicle goes around a corner, centrifugal forces will apply to the loads; the higher a load is situated, the greater such forces shall be. FIG. 2C, FIG. 2D and FIG. 2E show how loads can be accompanied within a standard pallet height x; in contrast, FIG. 2F shows how easily an unusual load can cause problems in logistics, when a standard height pallet cannot be used; no stacking is possible etc.

FIG. 3A shows a pallet with four boxes 32 placed thereon. However, many pallets are loaded with goods such that it is not intended to have further pallets stacked upon a first pallet, such as the case of the pallet 30 per FIG. 3B, which is loaded with a load 33 in a central area of the pallet 30, or where shrink/stretch plastics has been wrapped about a load, whilst providing greater security, minimizing the possibility of movement of the goods in transit, can dispense with any sides to a palletized load, preventing any possibility of stacking. Additionally, once placed upon a lower pallet, it is frequently the case that the pallet needs to be slid or offset across the tops of one or more pallets. For example, with a curtain-sided lorry, a forklift driver may not have been correct in the order of pallets being placed upon a truck and it may be desired to shift the loaded pallet sideways. Equally, in a warehouse, as a layer of palletized goods are built up, it may be desired to slide pallets of further layers backwards, from a front access point towards a rearward stack of pallets. Referring to FIG. 3C there is shown a pallet assembly 34 having first and second base and lid members 35, 36, with the base member providing a forklift tine access channel on an underside together with a peripheral ledge support 37 for cylindrical sleeve 38, the cover 36 having guide ribs to enable the fitment of the sleeve at the top.

Object of the Invention

The present invention seeks to provide a solution to the problems addressed above. The present invention seeks to provide a system that can enable goods to be securely and reliably horizontally, vertically and offset stacked, despite different sizes of base support members such as pallets, if any, whereby wasted volumes arising from the presence of irregular loads, pallets or pallets of different levels or different load ratings in storage and transport can be minimized.

Furthermore, the present invention seeks to provide a system for both pallet-borne goods and non-pallet-borne goods that protects the goods and enables stacking. The present invention also seeks to provide a temperature controlled transport/storage assembly for goods palletized or otherwise, whereby goods can be maintained within an atmosphere having a predefined temperature range.

SUMMARY OF THE INVENTION

In accordance with a general aspect of the invention, there is provided a substantially cylindrical transport/storage assembly comprising a sleeve and a cover, wherein the sleeve comprises a single element and is capable of being flat packed when not in use; wherein, in use, the sleeve provides upstanding walls and the cover is operable to provide a closure for the sleeve whereby to provide an enclosed load/storage volume; wherein the upstanding walls extend from feet operably in contact with a base support surface and terminate with an uppermost lip operable to support a lower surface of said cover, the cover having engagement means to locate with the uppermost lip of the sleeve, wherein the cover provides an upper support surface, and the walls define at least one aperture to permit access for at least one tine of a lifting device; wherein said engagement means enable secure lateral fitment of the lid with respect to the sleeve and is operable to allow further assemblies together with any associated loads to be mounted upon and be supported by the cover. By having a wall, which can be folded in a flat fashion when not in use, the actual useful storage space of a warehouse, racking system, loading bay, lorry, train wagon or other form of ground/working area support surface can be increased. In a commercial vehicle delivery system, pallets loads can be protected and stacked; equally, non-palletized loads can be protected and stacked; whilst on a return journey a totally different type of load can be transported with the inventive sleeves, being stored with a reduced space configuration, whereby to assist in a logistics business.

Conveniently, the engagement means of the cover comprises one or more downwardly directed channels, which limit movement of the upstanding lip surfaces of the walls upon placement of the cover on the walls. Equally, the engagement means could comprise, for example, along two sides adjacent one corner a couple of channels associated with two of the sidewalls which are directed horizontally towards the opposite side of the and there are a couple of downwardly directed channels from the underside of the cover, which engage with the upper edge lips of the sidewalls opposite the corner with the horizontally directed channels, once the horizontally directed channels have received the opposite side of the cover. By using such channels, in one of a variety of fashions, then the combined, slot-together features have been shown to add considerable integrity to the transport/storage assembly.

Additionally, the upper surface of the cover can be provided with upwardly directed lips which can engage with the feet of an additional cylindrical transport/storage assembly stacked thereon.

The sleeve of the transport/storage assembly can be fabricated from one or more types of panel including extruded polystyrene, polyurethane foam, expanded polystyrene, cardboard, laminated polyurethane foam, laminated expanded polystyrene. The laminate face can comprise, for example, one of card, plywood, polypropylene, aluminum or steel. The sleeve can comprise panels and hinges, wherein the hinges enable the panels to be substantially rigid. If the sleeve is formed from cardboard, then the cardboard could be folded to provide hinges integral with the cardboard structure. The cardboard employed can be selected from common grades such as single, double, triple or quadruple corrugated cardboard. Conveniently, such cardboard is treated with at least one of wax, resin, paint or other known waterproofing methods, whereby full waterproofing can be provided.

It is recognized that, conveniently, a transport/storage assembly in accordance with the invention comprises a sleeve comprising four walls and is dimensioned such that it can be placed about a pallet base or other type of product to be transported or stored or when placed upon a support surface.

The cover is conveniently manufactured using laminated cardboard, but it may be desired, for example, that the top of the cover is provided with wooden slats, with two bonded layers of corrugated cardboard (or alternatives), together with formed plastics or resin impregnated fiber molded elements to define "L"-section elements which define a channel in conjunction with an upstanding element relative to the underside of the cover or "U"-section elements, which are attached by suitable fixing means such as one of adhesive or screw-fastening means. The cover can be made from a variety of materials, such as from cardboard sheets, molded fiberboard, a formed plastics or molded resin impregnated fiber or similar. Equally, it will be appreciated that additional thermally insulating products can be employed in or around the sleeves and cover. An aperture or cut-out can be defined within a wall of the sleeve, to enable access within the assembly. Linking members can be provided whereby to link adjacent assemblies other horizontally or vertically one with respect to the other, by means of coupling holes, straps and latches arranged along edge portions of the assemblies. Shrink-wrap can also be employed to secure loads for transport and to reduce or minimize interference.

The base support surface upon which transport/storage assembly is placed can comprise one of a ground surface (generally), a floor associated with one of a support bench/ storage-racking system associated a stores area, a workshop/office/storage area, a load floor of a transport vehicle and a cover of another cylindrical transport/storage assembly. By having a wall, which can be folded in a flat fashion when not in use, the actual useful storage space of a warehouse, racking system, loading bay, lorry, train wagon or other form of ground/working area support surface can be increased.

In accordance with a still further aspect of the invention, there is provided a flat pack pallet assembly; the sleeve member being capable of being folded, such that when stored or transported when not in use, it takes a minimum amount of space; the cover are effectively planar sheets with at least one of a lip or a centralizing insulation member which is attached to the underside of the cover or lid such that when the cover is placed over the sleeve, the insulation member abuts against the inside walls of the sleeve or any inside insulating member associated therewith. A pallet assembly in accordance with the present invention may be assembled in a rapid and expeditious manner. The two parts making up the pallet assembly may be stacked for storage in a relatively small space, conveniently being prior attached to a panel for a container, and may be associated with a container also arranged in a flat-pack style.

In accordance with a still further aspect of the invention, there is provided a method of fabrication of a transport/storage assembly, the method comprising the steps of arranging the sleeve in an upright position and placing the lid upon the upstanding element of the sleeve.

The present invention, can also be employed for temperature sensitive goods, where the sleeves are either highly insulating in themselves or benefit from further internal and or external thermally insulating media comprising panels, sleeves or other insulating materials. By having a pallet or other type of load enclosure substantially air tight, using additional base insulation, especially when cool packs are employed, the benefits are significant since, not only would an exchange of air with the atmosphere outside the container contribute to an increase in temperature within a container, the exchange of air with the atmosphere outside the container will also bring about condensation of the saturated air when cooled and possible frosting upon the cool packs, generally increasing the rate of exchange of energy between the atmosphere and the goods being transported. Additionally, in one embodiment, the invention also benefits from its ability to use the same size temperature control packs to be utilized in different containers; commonality of parts between ranges of product can provide more cost-effective construction and/or different functionality.

BRIEF DESCRIPTION OF THE DRAWING FIGURES

For a better understanding of the present invention, reference will now be made, by way of example only, to the Figures as shown in the accompanying drawing sheets, wherein:

FIG. 1A and FIG. 1B illustrate two known forms of pallet;

FIG. 2A and FIG. 2B illustrates an arrangement of pallets upon racks and within a commercial vehicle;

Figure 2B:
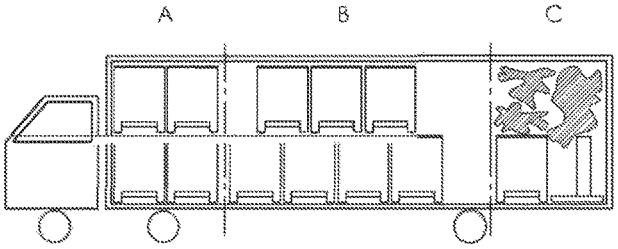
Figure 3A:
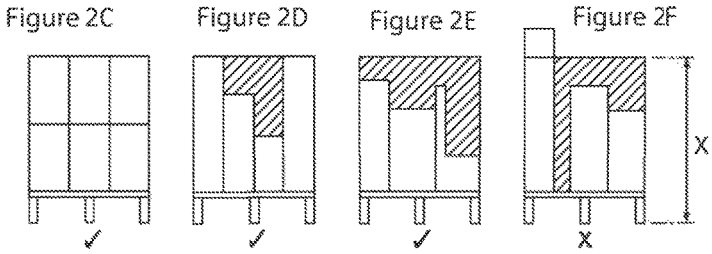
Figure 3B:
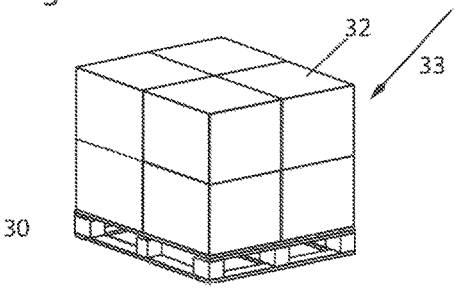
Figure 3C:
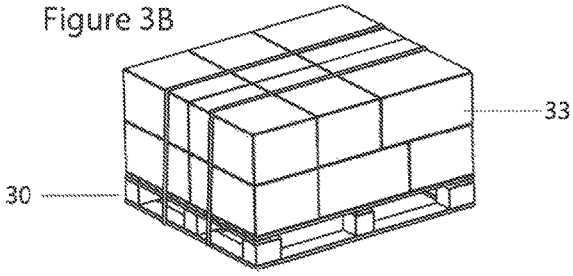
Figure 3C:
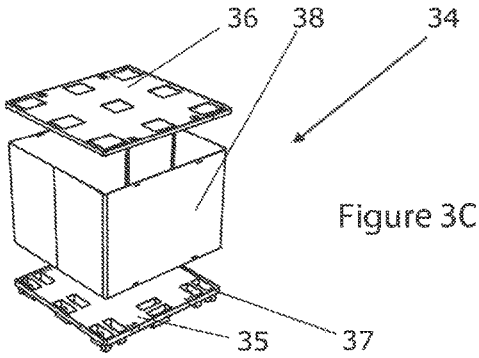
Figure 8A:
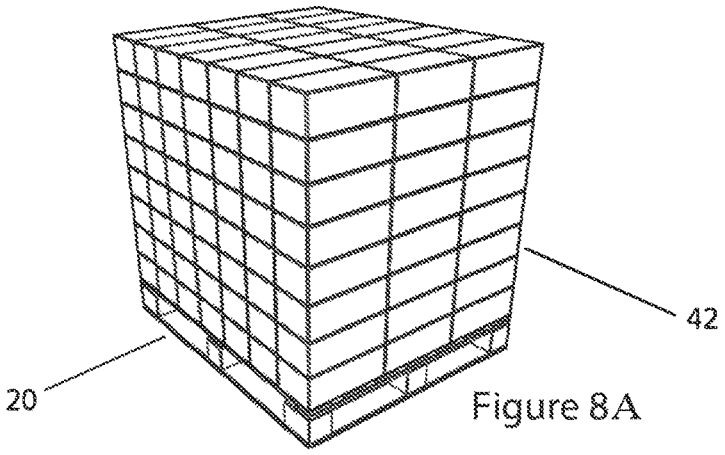
Figure 8B:
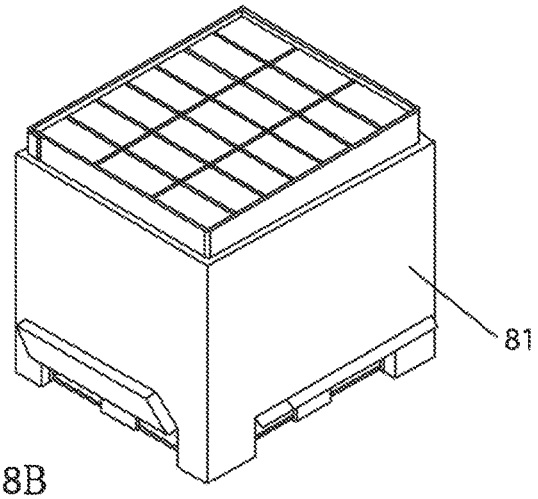
Figure 8C:
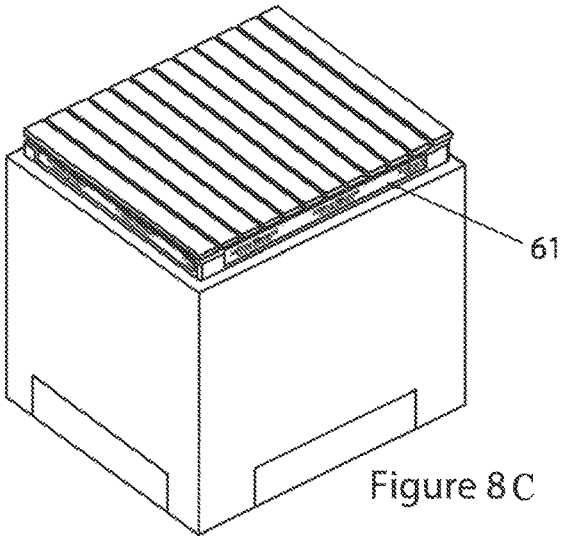

FIG. 2C, FIG. 2D, and FIG. 2E shows several examples of how pallets are typically loaded;

FIG. 2F illustrated a problem when a standard pallet cannot be used or stacked;

FIG. 3A, FIG. 3B and FIG. 3C show prior art pallet systems;

FIG. 4 shows a typical non-integrated pallet with a load;

FIG. 5A and FIG. 5B show a first component in accordance with one aspect of the invention in perspective and side views, respectively;

FIG. 5C, FIG. 5D, FIG. 5E, FIG. 5F, FIG. 5G and FIG. 5H detail various aspects of two lids in accordance with the invention;

FIG. 5I show how multiple lids can be stacked on top of one another;

FIG. 5J shows how the sleeve can be stored in a folded state;

FIG. 5K shows how a load can be distributed across a lid in accordance with the invention;

FIG. 6A, FIG. 6B, FIG. 6C and FIG. 6D show two assemblies in accordance with the invention in stacked and vertically coupled orientations, with details of connecting members in cross-section;

FIG. 6E, FIG. 6F, FIG. 6G, FIG. 6H and FIG. 6I show distinct features of differing covers in accordance with the invention;

FIG. 7A and FIG. 7B show the construction of one transport/storage assembly with a load, prior to and subsequent to the placement of a cover;

FIG. 7C and FIG. 7D show how expanded and complete views of first and second transport/storage assemblies in accordance with the invention being stacked;

FIG. 7E, FIG. 7F, FIG. 7G, FIG. 7H and FIG. 7I detail aperture and aperture reinforcement features;

FIG. 8A, FIG. 8B and FIG. 8C show three views of a transport/storage assembly in accordance with another aspect of the invention;

FIG. 8D and FIG. 8E show two insulated transport/storage assemblies;

FIG. 9A, FIG. 9B, FIG. 9C, FIG. 9D, FIG. 9E, FIG. 9F and FIG. 9G show two further insulation systems with plan views of elongates insulation retaining members;

FIG. 10A, FIG. 10B and FIG. 10C show further configurations of the invention;

FIG. 11 shows how the present invention can be stacked;

FIG. 12 shows how the present invention can be used in a warehouse;

FIG. 13A and FIG. 13B show side and plan views of a commercial vehicle carrying embodiments of the present invention; and, FIG. 14 shows how refrigerant phase change pack can be placed upon a loaded pallet, prior to a cover being secured; and, FIG. 15A, FIG. 15B, FIG. 15C and FIG. 15D show a further embodiment.

DETAILED DESCRIPTION

There will now be described, by way of example only, the best mode contemplated by the inventor for carrying out the present invention. In the following description, numerous specific details are set out in order to provide a complete understanding to the present invention. It will be apparent to those skilled in the art, that the present invention may be put into practice with variations of the specific.

FIG. 4 shows an example of a pallet 20 supporting a load 42; the load placed upon the pallet so that the outer extent of the load corresponds with the area of the pallet base. Whilst the pallet 20 is not shown in any great detail, it is manufactured from wood and is a four-way entry pallet, wherein the tines of a fork lift or similar tined lifting device can insert its tines through gaps typically having a lowermost height of 100-120 mm, but this will vary, dependent upon the material of manufacture of the pallet and the load to be supported. FIG. 5A shows a cardboard cylindrical sleeve 51 in accordance with a component of the invention. The cardboard, comprises four walls 55 and is dimensioned such that it can be placed about a pallet base when placed upon a ground surface or other support surface and comprises a generally cylindrical member, and can simply be manufactured, for example, from a single sheet of cardboard, glued or otherwise attached along a mutually overlapping portion, conveniently being a corner of a rectangular cylinder. Equally, the sleeve could comprise an elongate rectangular sheet, with fold lines to act as hinges or specific hinges between side walls, with two ends that can be removably fastened, whereby to enable a sleeve to be assembled or dissembled. This particular embodiment shows a first ground aperture portion 52 defined between a ground contact skid or foot portion 54 (collectively the feet of the assembly). The other side corresponds, converting the 4-way entry pallet of FIG. 4 into a two-way entry pallet assembly. In use, the tines of a fork-lift truck are introduced into the region defined by the aperture, which is conveniently at least 140 mm high, whereby when a palletized load is present within the transport/storage assembly and it is desired to move the palletized load, then the tines of the lifting device are inserted so that they pass through the assembly and extend to the other side. Initially the tines contact the underside of the pallet and lift the pallet and then engage the underside of the walls defining the top of the aperture.

In FIG. 5A, optional apertures 53, are placed within the walls 55, to assist in placement of the sleeve about a pallet. It has been found that by the provision of support member inserts about the downwardly directing edges of the apertures for the tines in the sidewall, the lower surface is sufficiently strengthened to accept repeated use of tines associated with forklift trucks and other types of tined lifting apparatus. Applicants have therefore been able to reduce the number of components in a transport and storage system to a foldable sidewall and cover therefor.

In the manufacture of development products, Tri-Wall Europe Limited corrugated cardboard products have been utilized, who produce high performance corrugated board specifically developed for heavy-duty packaging applications. There are several standard Tri-Wall board grades, and widths ranging from 3 mm, to 15 mm, with differentiators including the weight of the papers and the flute profiles, as well as the number of corrugations, the use of wet strength resins and wet strength adhesives to give good-excellent performance in moist or humid conditions. It is also possible to coat the board to provide further moisture protection, for example.

In use, the sidewalls can be employed to surround loads in their own right or, for example, loads placed upon pallets; subsequently a cover can be placed upon the sidewalls, conveniently engaging with the upstanding edges or lips of the sidewall, to provide a secure enclosure for the load. Therefore, the load is shielded from dust and other interference; the load cannot be tampered with easily and further loads can be placed upon the cover. In tests, a widely available (and therefore available at an economical cost) 15 mm Tri-Wall 1250 grade board has been used for the sleeve, with respect to a container suitable to surround a Euro Pallet—having dimensions of 1250 mm×1000 mm. This has been found to provide sufficient strength to support loads approaching 1000 Kg from a cover, but a safe working limit upon the covers would be 300-600 Kg. Obviously different grades of cardboard will provide different working weigh limits. Using standard 15 mm thick corrugated cardboard sidewalls, for example, as a euro-pallet enclosure, it has been determined that a weight of 1000 Kg can be supported—meaning, that a working limit of 300-600 Kg can be defined, taking into account potential deterioration over time and possible incompetence of handling in use. Moreover, it has been found that standard height loads can be safely stacked up to three high, with health and safety issues necessitating a limit in view of possible overloading in use. Notwithstanding this, the skilled man will realize that a greater number of half-height transport/storage assemblies can be stacked.

FIG. 5B shows a sleeve in accordance with the invention—when assembled and showing only one side 55 of the assembly, with a first lid 56, having an "L"-section member 57: FIG. 5C shows a side view of a second type of top 59, the differences between the two lids can be simply determined with reference to respective plan views as shown in FIGS. 5D and 5E, and, in particular, FIG. 5F. The "L"-section member can be formed as an extruded paper corner-board, which products are available from many paper and cardboard suppliers—for example, they are made by companies such as ITW (under their ANGLEBOARD™ brand). Specifically, FIG. 5C shows a lid wherein "L"-section member 57 lies external to the upper wall section 55 shown in the figure, but only extends across half the distance of the cover panel, from the left hand side to the center of the side panel. FIG. 5D shows how the "L"-section member lies from a plan view. In FIG. 5D, FIG. 5F lid 59 has two "L"-section members, 57, 58, which lie on the perimeter and surround the upper lip edges of the sidewalls of the container when placed on the lid. The "L"-section member conveniently comprises an extruded paper corner-board, with section dimensions of 35 mm or 45 mm and is readily available as discussed with reference to the aperture reinforcement; again, the "L"-section member can be attached using hot-melt glues, for example, whilst other types of materials can be used to manufacture such "L"-section members, including plastics, especially extruded plastics.

FIG. 5F shows how the upper part of the lid 56 is formed, using three layers 72, 73, 74 of sheet material. Conveniently, the material is corrugated cardboard; conveniently, the directions of the corrugations are perpendicular as between adjacent layers. For example, the cover can be manufactured from bonded layers of triple-layer (corrugated) corrugated cardboard, with the orientation of the two layers of cardboard being orthogonal with respect to each other, whereby bending the board along one axis will not cause the board to become creased. Extruded plastics corrugated board can also be employed. It is also preferred that the thickness of the middle layer 73 corresponds with the thickness of the "L"-section members. Variations on the construction can be easily be implemented. It has been found that two layers are sufficient, of Tri-wall type 1700 and 440 grades, respectively, with a further layer of thicker material of reduced peripheral dimensions, defining, in conjunction with the "L"-section elements a channel, which receives the uppermost lip of the upstanding walls 55, in a closely fitting relationship. FIG. 5G and FIG. 5H show, respectively, an underside of the lid 56 shown in FIG. 5F with the insert 74 only present in FIG. 5H; the addition of the insert 74, upon sheet 73 defines a channel 77 where it lies adjacent the "L"-section member 5.

FIG. 5I show how the lids 59 can be stacked one atop another in a simple fashion; as indeed the sleeve can be laid upon two sides and can be stored in a folded state, per FIG. 5J. FIG. 5K shows how the forces 80 arising from the weight of a barrel 79 upon a lid 59 are act through the walls of a container by the use of the laminated lid 59.

Figure 6A:
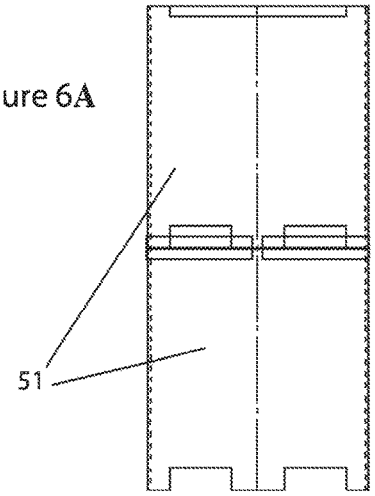
Figure 6B:
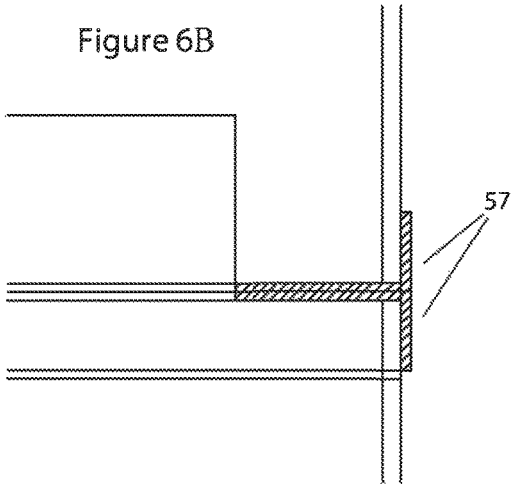
Figure 6C:
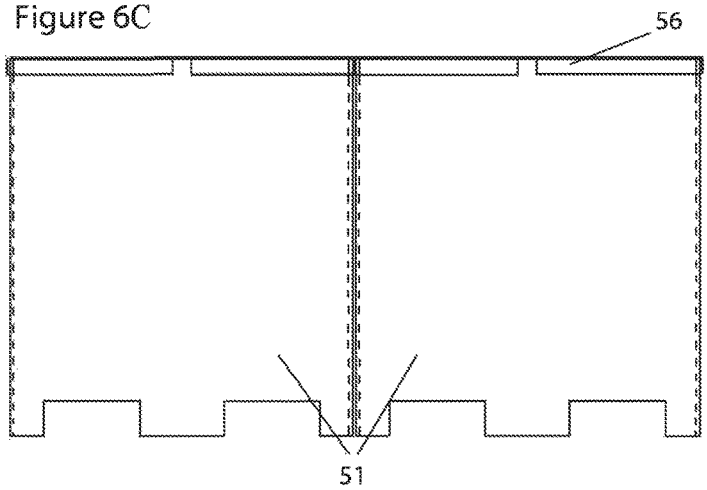
Figure 6D:
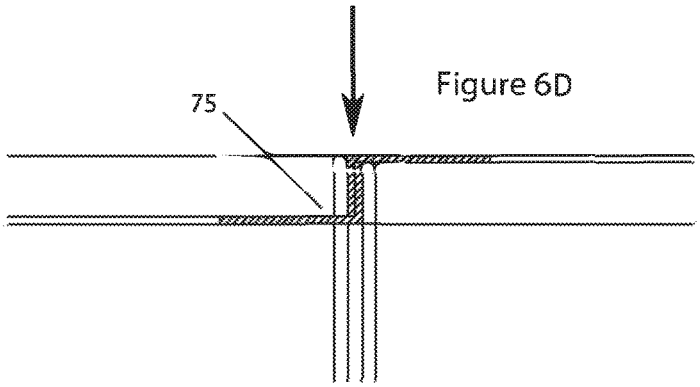

FIG. 6A and FIG. 6B detail a still further embodiment wherein the element 57 is configured as a "T"-section element whereby the cover can prevent slippage of a secondary storage/transport assembly. In a stacked configuration, shrink wrap material can be applied about the two assemblies, whereby to secure the two assemblies together. Shrink wrap, also shrink film, is a material made up of a plastics polymer film. When heat is applied, it shrinks tightly over whatever it is covering. Heat can be applied with a handheld heat gun (electric or gas). Such a technique can be employed around three or more assemblies in a stacked arrangement, bearing in mind that the height of an assembly need not be a fixed height, with half-height assemblies being used for low-height products etc. Note also that fillings, e.g. card-based pellets manufactured from waste material may also be placed within a container to fill voids, which may otherwise allow unwanted movement within an assembly. FIG. 6C and FIG. 6D show how two adjacent storage/transport assemblies can be fastened using an "L"-shaped connector 75 to locate one storage/transport assembly 51 with respect to the lid of an adjacent transport/storage assembly 51.

Details of another cover, not too dissimilar to FIG. 5F is shown in FIG. 6H and FIG. 6I, wherein an intermediate sheet material 73 has a cut-out portion 74 into which "L"-section member 57 can be inserted, as shown in FIG. 6I, with top layer 72 in place. It will be appreciated that other materials can be used. For example, the cover could also comprise formed plastics or resin impregnated fiber molded elements, strengthened as appropriate, whereby a more durable product can be provided.

FIG. 7A shows how the cardboard sleeve 51 in accordance with one aspect of the invention can be positioned about pallet 20 with load 42 placed thereon. Cardboard sleeve is reinforced to a degree suitable for purpose: conveniently, the cardboard sleeve is made from industry standard single, double, triple or quadruple corrugated cardboard. In view of the ability of untreated cardboard to absorb water from precipitation or from the atmosphere, the cardboard should be adequately treated, by wax, resin, paint or other known waterproofing methods. When using corrugated board formed from 440 gm-2 wet strength Kraft paper, this type of board has a weather resistance which satisfies a 2-hour water immersion test without any ply separation.

FIG. 7B shows how the cover or lid 61 fits closely over the outside of the sleeve. The inside channel 77 (FIG. 5H) being defined, to assist in securely locating the sides of the sleeve upon fitment of the cover to the transport and storage assembly. FIG. 7C shows how a second pallet 71 and load 72 can be placed upon the cover 61 on the first, lower pallet 20 and load 42. FIG. 7D shows an assembly of two pallets 20, 71 having loads 42, 72.

With reference to FIG. 7E, twin apertures 52 are shown in wall 51, with each aperture having a "U"-section reinforcement member 43. It has been found that when the sleeve is formed from materials such as cardboard, the underside of the aperture benefits from having such a reinforcement member, formed from a material such as an extruded paper corner-board, in correspondence with the thickness of the cardboard panel 51, e.g. 15 mm, which products are available from many paper and cardboard suppliers—for example, they are made by companies such as ITW (under their ANGLEBOARD™ brand) and are available in various lengths and channel sections. FIG. 7F, FIG. 7G, FIG. 7H and FIG. 7I show cross sections through an aperture 52 within a wall 51 where reinforcement members of "U"-section 43, "L"-section 44, "F"-section 45 and top-hat section 46 are present. Conveniently, the product comprises a "U"-section channel, which can be clipped about the lower edge, although it is preferable that an adhesive is also used, such as a hot-melt glue. Other types of materials can be used to manufacture the channel members, such as extruded polypropylene, extruded aluminum, laminated glass fiber, laminated card etc.; composite board supplies are, however, plentiful and reasonably priced.

In addition to a requirement for waterproofing, in order to strengthen the material, one or more of a number of options may be selected: the number of layers of sheets may be increased—e.g. for a corrugated board, the sheets as a whole, or merely just the corner sections, can be reinforced so that they have two, three of more layers; any corrugated flutes could be filled with elongate support members or strengthening members, which could be plastic rod, metal, wood or any of a number of alternative materials which can be placed within the corrugation flutes, conveniently glued or otherwise permanently attached. Additionally, distinct materials such as batons or, preferably, sheet materials are provided where extra strength is required. Note that because of aperture 52 for the forks of a lifting mechanism such as a forklift truck, such strengthening means are conveniently applied only where weight can be easily be transferred from the lid to the base contact portion of the sleeve or sheath can be borne. For additional bearing strength, the single aperture 52 could be replaced by two single apertures, although the central support may well get easily damaged in use through inadvertent positioning of forklift truck forks against the cardboard and the support about the aperture 52, in particular.

However, cardboard is not the only suitable material; Card/paperboard, plastics sheeting, formed plastics panels corrugated plastics sheeting, plywood and other sheet materials can be employed, the choice being determined upon requirements for specific use, such as weight to be supported, number of uses expected and such like.

FIG. 7B shows how the cover or lid 61 fits closely over the outside of the sleeve. Although not required for all purposes, an inside groove could be defined, to assist in locating the sides of the sleeve upon fitment of the cover to the pallet assembly. FIG. 7C shows how a second pallet 71 and load 42 can be placed upon the cover 61 on the first, lower pallet 20 and load 42. FIG. 7D shows an assembly of two pallets 20, 71 each with load 42.

FIGS. 8A, 8B and 8C show a similar situation of a pallet 20 with a load 42 being encased with a thermally insulating sleeve 81 and then fitted with a cover: the cover may have additional insulation or the insulation may be provided within the sleeve, by, for example a top layer comprising insulation. The addition of insulation may be performed by the provision of a separate sleeve about the outside of the sleeve 51 or may be attached by adhesive noting that whilst assisting in maintenance of a unitary sleeve is of advantage, there may well be difficulties in folding the double sleeved arrangement into a compact, minimum thickness flat-pack, especially if the insulation is, say, 10 cm in thickness. FIG. 8D shows how two insulated pallet assemblies are brought together and FIG. 8*e* shows two insulated pallet assemblies connected together. FIG. 8D shows how the external insulation provides foldable aperture covers or aperture doors 84 which are operable to allow the passage of the tines of a fork lift device through the apertures 52. By being cut through in part, certain plastics foam insulation materials may provide its own hinge, although a hinge element could also be separately provided. At rest, with the fork tines removed, the aperture covers will return to their rest position such that the edge either abuts the floor or the cover of the pallet below. Although not shown, connection means can be provided to ensure that the feet of an upper pallet do not move with respect either one or both of adjacent horizontally spaced pallet assemblies or to the cover of a pallet below. FIG. 8D also shows a further insulation member 83, which lies upon the pallet prior to placement of contents upon the pallet.

FIG. 9A shows a still further system of attachment of insulation to a wall panel, where "U"-section elements 90 are placed along two opposite sides of a wall panel 55 i.e. top and bottom or, preferably, respective left and right sides of each panel. Two opposed "U"-shaped channels define slots operable to accept corresponding sides of an insulating panel 91, external to a wall of the sleeve 55. The "U"-section members can be attached with double sided tape, hot-melt glue or other adhesive; hook and loop fastenings could also be employed, whereby the "U"-shaped channels can be removed. With reference to FIG. 9B, a plan view of a still further embodiment of the invention is shown, wherein four different types of double-"U" channels are provide, whereby only four members need to be attached to retain four insulation panels 91, such low density polyethylene (LDPE) foam sheet, as shall be detailed below. FIG. 9C, FIG. 9D, FIG. 9E and FIG. 9F show four types of double-"U" channels, which are placed around the plan view of FIG. 9B; it can be seen that the different double-"U" channels per FIG. 9C, FIG. 9D, FIG. 9E and FIG. 9F correspond to the double-"U" channels employed at the respective corners identified "c", "d", "e" and "f". Double-"U" channels 9*c* and 9*d* do not provide full corner insulation whilst double-"U" channels 9*d* and 9*f* can only be used on the corners which fold inwardly (i.e. the two panels fold towards each other) as the container is folded for storage etc. or otherwise be irremovably fastened.

FIG. 9G shows a still further variation of insulation, wherein two sides of the sleeve are shown, whereby to enable two insulation panels 93, 94, which have respective rebates 95, 96 which are, ideally, slightly over size, whereby to ensure that air does not pass between adjacent rebate edges when placed together and in use—i.e., the insulation panels are in compression along the contact mating surfaces.

Conveniently, the insulation material would comprise of expanded or extruded polystyrene or polyurethane foam and have a thickness of approximately 50-80 mm. The corners of the rectangular container can be protected by heat formed corner edges, alternatively or additionally also being provided with "L"-section medium Density Fiberboard (MDF) corner protectors, in a similar fashion to the lips of the lid or top cover. The foam insulating panels of could also be of a laminated construction, whereby, using different densities of foam a lightweight yet stiff structure can be provided. Conveniently, these can be provided by commercially available HCFC-free expanded Polyethylene sheet (LDPE), where there is a closed cell structure with extrusion skin. This provides a low water absorption and water vapor transmission rate. Such foams typically have a high degree of resiliency and flexibility, excellent cushioning behavior and excellent thermal insulation properties, with a temperature stability of −40° C. to +70° C. Commercially available foams of such construction are manufactured by companies such as Knauf Insulation Ltd., Sealed Air Inc. etc.

FIG. 10A shows a first variation of the sleeve configuration, wherein an aperture 97 is shown, defined within a wall 55 of the sleeve. FIG. 10B shows a still further variation, wherein the wall 98 has a cut-out portion, whereby only a top edge member 99 provides lateral support, although a removable member, conveniently—but not limited to such—being made from cardboard or comprising an "L"-shaped MDF member. FIG. 10C shows such a variation per FIG. 10A or FIG. 10B which is further provided with a cover 101 which is attached by fastenings 102. In the alternative, the cover may comprise a hinged door.

FIG. 11 shows how the transport and storage embodiments made in accordance with the invention can be stacked one atop the other and side by side, without pallets being present, although pallets—or indeed any products of a suitable width can be inserted through the apertures 57, 58.

FIG. 12 shows how a number of transport and storage device in accordance with the invention can be provided within a warehouse 120. FIG. 13A and FIG. 13B show how a lorry 130 with a flat load bed 131 having open sides, in fully loaded and partially loaded configurations, respectively, can transport a number of transport and storage devices in accordance with the invention. Equally, small vans can be provided with a number of such transport and storage devices of reduced height, whereby the effective load capacity is increased substantially, which is especially useful for local delivery purposes. By having half-height transport and storage devices, the number of load areas can be increased, whilst being removable from the vehicle, upon the unfastening of any straps and linking members between adjacent devices—whether to the side or above and below. It will be appreciated that if a larger item needs to be carried, the storage devices, with pallets or not can be either removed from the van or lorry or be stored in a flat-pack arrangement, to enable a particular load to be carried.

In a further alternative, the sleeves may comprise specific insulation panels or such insulation panels may be fitted within the cardboard sleeve. The insulation panels may be separate elements or may also comprise a cylinder, which can be folded with corner assemblies by having interlocking tongue and groove members (not shown), it is also possible to substantially reduce the movement of air as between the exterior of the assembly and an interior of the assembly by the use of a flat base panel lying upon the support surface, or pallet and being of a slight oversize with respect to the internal walls, whereby air cannot pass between an insulating base member and the walls. The insulating inside panels need not extend to the feet of the cylinder walls, whereby the base is only enshrouded by the sleeve. A rebate within the lower portion of the insulating sidewalls and optionally of the base panel can effectively provide an airtight base and wall assembly. By using similarly dimensioned components at the top of the assembly, a good airtight seal at the top can also be provided, thereby increasing the thermal insulation characteristics of the completed box. Further ties may be required to prevent unwanted or accidental opening of the pallet enclosures when they are used.

Referring now to FIG. 14, there is shown a top, exploded view of a transport/storage assembly with an insulated lid 142: below the lid, upon an insulating spacing element and coolant support 141 there is provided coolant packages 143 such as phase-change medium (PCM) packages which are selectively cooled to provide a temperature profile for a particular class of good for a period of time—typically 24-120 hours—whereby temperature sensitive goods can be transported within a specific temperature range. In an alternative, such coolant packages are provided in supports upon a wall.

Figures 15A, 15B, 15C, 15D:
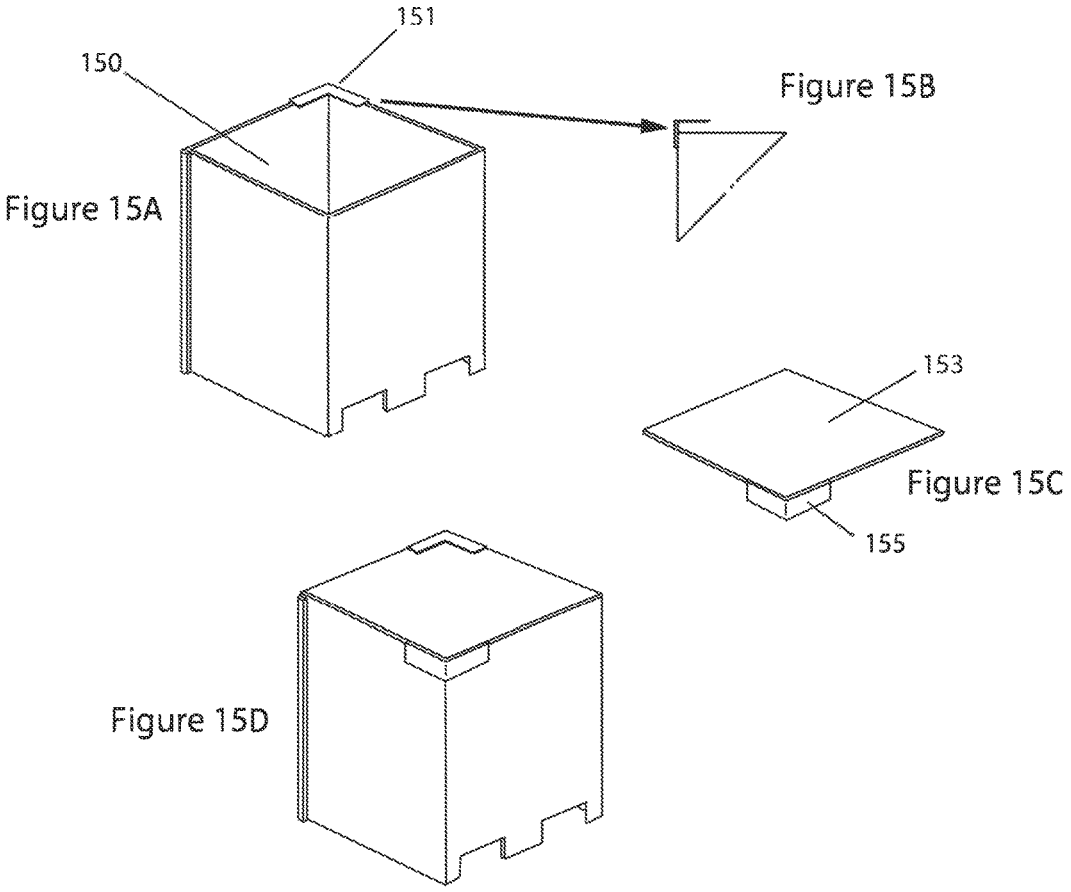

FIG. 15A shows a further embodiment, wherein a sleeve 150 has an "F"-section element 151 depending from an upper wall edge or lip. As seen in FIG. 15B, a "C"-section channel is provided into which corner 153 of lid 152 can be located, as seen in FIG. 15C. Opposite corner 154 of lid 152 is provided with an "L"-section element 155, either r side of the corner, in a similar fashion to the embodiment shown with reference to FIG. 5C and FIG. 5E. In use, corner 153 is inserted into the "C"-section channel, as the opposite edge 154 is located over the upstanding wall edges. To provide an alternative embodiment as shown in FIG. 15D.

Whilst the present invention enables greater flexibility in the positioning of loads, whether employing a pallet or not, and the stacking thereof, such stacking should only be performed subject to the ability of base-level transport/storage assemblies to take additional weight. Dependent on the height, strength and stability of the assemblies and the ability of the operator to see clearly, taller stacks may only be built following detailed consultation with the manufacturer or other competent authority. To assist in the management of closely stacked and closely coupled load enclosures or pallet enclosures, the sleeves should be connectable with their associated pallets using a locking bolt or similar, noting that such locking bolts, preferably present a flush external surface finish, to enable adjacent coupling, but ideally such flush bolts can assist in the close coupling of transport/storage assemblies.

What is claimed is:

1. A substantially cylindrical transport/storage assembly comprising a sleeve and a cover;

wherein the sleeve comprises a single element and is capable of being flat packed when not in use;

wherein, in use, the sleeve provides upstanding walls and the cover is operable to provide a closure for the sleeve whereby to provide an enclosed load/storage volume; wherein the upstanding walls extend from feet operably in contact with a base support surface and terminate with an uppermost lip operable to support a lower surface of said cover, the cover having engagement means to locate with the uppermost lip of the sleeve, wherein the cover provides an upper support surface, and the walls define at least one aperture to permit access for at least one tine of a lifting device;

wherein said engagement means comprise at least an "L"-section member, and wherein the engagement means enable secure lateral fitment of the lid with respect to the sleeve and is operable to allow further assemblies together with any associated loads to be mounted upon and be supported by the cover; and wherein the cover is manufactured from a formed plastics or resin impregnated fiber molded element and wherein the "L"-section member is integrally formed therewith.

2. The assembly of claim 1, wherein the engagement means of the cover comprises one or more downwardly directed channels which limit movement of the upstanding lip surfaces of the walls upon placement of the cover on the walls.

3. The assembly of claim 1, wherein the sleeve supports one or more horizontally directed channels operable to receive at least one edge member of the cover, whereby, upon fastening, one edge of the cover, at a first side of the cover is received into the horizontal channel and the cover at a side opposite to the first side is permitted to engage with the upstanding sleeve wall of the corresponding side.

4. The assembly of claim 1, wherein the upper surface of the cover is provided with upwardly directed lips which can engage with the feet of an additional cylindrical transport/storage assembly.

5. The assembly of claim 1, wherein the sleeve is fabricated from one or more panel materials including extruded polystyrene, polyurethane foam, expanded polystyrene, cardboard, corrugated cardboard, molded plastics, corrugated plastics panel, laminated polyurethane foam, laminated expanded polystyrene and plywood.

6. The assembly of claim 1, wherein the sleeve is fabricated from one or more panel materials including extruded polystyrene, polyurethane foam, expanded polystyrene, cardboard, corrugated cardboard, molded plastics, corrugated plastics panel, laminated polyurethane foam, laminated expanded polystyrene and plywood; and, wherein the sleeve comprises panels and hinges, wherein the hinges enable the panels to be substantially rigid.

7. The assembly of claim 1, wherein the sleeve is fabricated from one or more panel materials including extruded polystyrene, polyurethane foam, expanded polystyrene, cardboard, corrugated cardboard, molded plastics, corrugated plastics panel, laminated polyurethane foam, laminated expanded polystyrene and plywood; and, wherein the sleeve comprises panels and hinges, wherein the hinges enable the panels to be substantially rigid; and, wherein the substantially rigid panels comprise one of card, plywood, molded plastics, or sheet metal.

8. The assembly of claim 5, wherein the sleeve is fabricated from one or more panel materials including extruded polystyrene, polyurethane foam, expanded polystyrene, cardboard, corrugated cardboard, molded plastics, corrugated plastics panel, laminated polyurethane foam, laminated expanded polystyrene and plywood; and, wherein the sleeve is manufactured from cardboard being selected from single, double, triple or quadruple corrugated cardboard.

9. The assembly of claim 1, wherein the sleeve comprises four sheets of material with hinges between adjacent sheets.

10. The assembly of claim 1, wherein the cover is manufactured from one of wooden slats, two bonded layers of triple-layer corrugated cardboard, formed plastics or resin impregnated fiber molded elements and the "L"-section member is attached by suitable fixing means.

11. The assembly of claim 1, wherein the sleeve is provided with an additional thermally insulating sleeve which can either be fitted within the support sleeve or around the outside of the sleeve.

12. The assembly of claim 1, wherein one or more sheets of insulating foam plastics is wrapped around the outside of the sleeve.

13. The assembly of claim 1, wherein a further, access aperture or cutout is defined within a wall of the sleeve, to enable access within the assembly.

14. The assembly of claim 1, wherein the base support surface comprises one of a ground surface, a floor associated with one of a support bench/storage —racking system associated a stores area, a workshop/office/storage area, a load floor of a transport vehicle and a cover of another cylindrical transport/storage assembly.

15. The assembly of claim 1, wherein linking members are provided which can link adjacent assemblies other horizontally or vertically one with respect to the other, by means of coupling holes, straps and latches arranged along edge portions of the assemblies.

16. A substantially cylindrical transport/storage assembly comprising a sleeve and a cover;

wherein the sleeve comprises a single element and is capable of being flat packed when not in use;

wherein, in use, the sleeve provides upstanding walls and the cover is operable to provide a closure for the sleeve whereby to provide an enclosed load/storage volume; wherein the upstanding walls extend from feet operably in contact with a base support surface and terminate with an uppermost lip operable to support a lower surface of said cover, the cover having engagement means to locate with the uppermost lip of the sleeve, wherein the cover provides an upper support surface, and the walls define at least one aperture to permit access for at least one tine of a lifting device;

wherein said engagement means comprise at least an "L"-section member, and wherein the engagement means enable secure lateral fitment of the lid with respect to the sleeve and is operable to allow further assemblies together with any associated loads to be mounted upon and be supported by the cover; and wherein the cover is manufactured from one of wooden slats, two bonded layers of triple-layer corrugated cardboard, formed plastics or resin impregnated fiber molded elements and the "L"-section member is attached by suitable fixing means; and, wherein the "L"-section member conveniently comprises an extruded paper corner-board or plastics.

17. A substantially cylindrical transport/storage assembly comprising a sleeve and a cover;

wherein the sleeve comprises a single element and is capable of being flat packed when not in use;

wherein, in use, the sleeve provides upstanding walls and the cover is operable to provide a closure for the sleeve whereby to provide an enclosed load/storage volume;

wherein the upstanding walls extend from feet operably in contact with a base support surface and terminate with an uppermost lip operable to support a lower surface of said cover, the cover having engagement means to locate with the uppermost lip of the sleeve, wherein the cover provides an upper support surface, and the walls define at least one aperture to permit access for at least one tine of a lifting device;

wherein said engagement means comprise at least an "L"-section member, and wherein the engagement means enable secure lateral fitment of the lid with respect to the sleeve and is operable to allow further assemblies together with any associated loads to be mounted upon and be supported by the cover; and wherein the cover is manufactured from one of wooden slats, two bonded layers of triple-layer corrugated cardboard, formed plastics or resin impregnated fiber molded elements and the "L"-section member is attached by suitable fixing means; wherein the "L"-section member conveniently comprises an extruded paper corner-board or plastics; and wherein the cover is further provided with a laminations of sheet material layers whereby, in conjunction with the "L"-section members to define a groove for placement of the upstanding lips of the walls.

* * * * *